US010020149B2

(12) United States Patent
Dold et al.

(10) Patent No.: US 10,020,149 B2
(45) Date of Patent: Jul. 10, 2018

(54) CONTROL APPARATUS FOR CONTROLLING A SWITCHING ELEMENT

(71) Applicant: SICK AG, Waldkirch (DE)

(72) Inventors: Franz Dold, Waldkirch (DE); Jonas Weidenmuller, Waldkirch (DE); Stephan Henneberger, Waldkirch (DE); Frederik Behre, Waldkirch (DE)

(73) Assignee: SICK AG, Waldkirch (DE)

( * ) Notice: Subject to any disclaimer, the term of this patent is extended or adjusted under 35 U.S.C. 154(b) by 202 days.

(21) Appl. No.: 15/248,456

(22) Filed: Aug. 26, 2016

(65) Prior Publication Data

US 2017/0076891 A1 Mar. 16, 2017

(30) Foreign Application Priority Data

Sep. 11, 2015 (EP) ..... 15184905

(51) Int. Cl.
*H01H 47/00* (2006.01)
*H01H 71/04* (2006.01)

(52) U.S. Cl.
CPC ..... *H01H 47/00* (2013.01); *H01H 47/002* (2013.01); *H01H 2071/044* (2013.01)

(58) Field of Classification Search
CPC . H01H 47/00; H01H 47/002; H01H 2017/044
See application file for complete search history.

(56) References Cited

FOREIGN PATENT DOCUMENTS

| | | | |
|---|---|---|---|
| DE | 102011100305 | A1 | 12/2011 |
| EP | 0193732 | A1 | 9/1986 |
| WO | 2005104155 | A1 | 11/2005 |

OTHER PUBLICATIONS

SIPROTEC Numerical Overhead Contact Line Protection for AC Traction Power Supply 7ST6 Manual; V4.6; Nov. 9, 2012; Siemens Aktiengesellschaft.

European Search Report dated Feb. 29, 2016 corresponding to European application No. 15184905.6-1808.

*Primary Examiner* — Robert Deberadinis

(74) *Attorney, Agent, or Firm* — Nath, Goldberg & Meyer; Jerald L. Meyer

(57) ABSTRACT

To avoid additional costs, in particular by replacing a switching element too early or by expensive monitoring measures thereof, a control apparatus for controlling a switching element is provided. The control apparatus has an operating unit for setting a load stage at which the switching element can be operated, a control unit for calculating a first numerical value which reflects expected switching cycles of the switching element estimated on the basis of the set load stage and which corresponds to an expected service life of the switching element in dependence on the set load stage, and for determining a second numerical value which reflects effected switching cycles of the switching element. Information from a difference between the first and second numerical values or from a quotient from the second numerical value to the first numerical value during operation of the switching element is provided to a user.

17 Claims, 3 Drawing Sheets

CONTROL APPARATUS FOR CONTROLLING A SWITCHING ELEMENT

Figure 1:
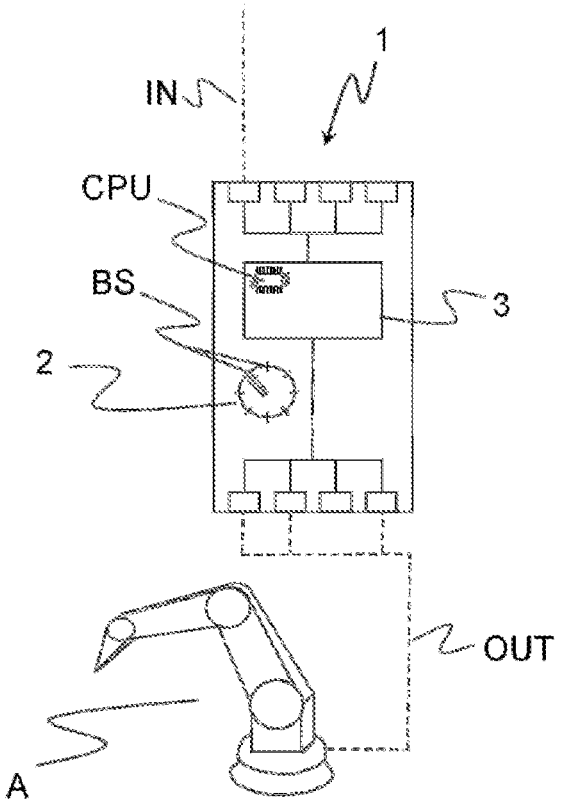

The invention relates to a control apparatus for controlling a switching element, preferably a mechanical relay, in accordance with claim 1.

In industry today, switching elements such as mechanical relays are used in a number of applications to control electrical devices connected via the switching elements. The switching elements, which are preferably mechanical, in this respect have a limited number of possible switching cycles which are comparatively low in comparison with non-mechanical switches such as transistors.

What is decisive in this respect is the service life of the switching contacts of the switching elements which predominantly depends on the load.

Since the switching elements are as a rule the weakest element in the grouping of a switching device, the expected service life under the given loads is of particular interest to plan servicing cycles for a plant or to make a statement on the duration of an error-free operation. Such a possibility would also be of interest for simple switching devices such as relay modules which do not have any link to an intelligent logic such as a higher-ranking programmable logic controller PLC, whereby this function could be outsourced.

The known (safety) relay modules recognize a failure of the relay such as contact welding and block the restart. The relay module subsequently has to be replaced. The user's attention is not drawn to an (imminent) reaching of the expected switching cycles by the device. He is only informed of the failure. Alternatively, he has to take his own precautions.

These precautions comprise the user, on the one hand, counting the number of switching cycles by means of an external logic and estimating from which point onward it is worthwhile replacing the relay. On the other hand, the user statistically determines when the relay is approaching the end of its service life and replaces the relay beforehand. In this respect, however, "intact" or "good" relays may be replaced. A third possibility comprises the user waiting until the failure of the relay to replace it then. However, this produces a standstill of the plant which has the consequence of production downtime costs.

Additional costs result from this in the maintenance of the relay or in the use of mechanical switching elements.

It is therefore an object of the invention to provide a control apparatus for controlling a switching element, in particular a mechanical switching element, which avoids additional costs on the use of switching elements.

The object is satisfied in accordance with the invention by a control apparatus for controlling a switching element, preferably a mechanical relay, having an operating unit for setting a load stage at which the switching element can be operated, having a control unit for calculating a first numerical value which reflects expected switching cycles of the switching element estimated on the basis of the set load stage (BS) and which corresponds to an expected service life of the switching element in dependence on the set load stage (BS), and for determining a second numerical value which reflects effected switching cycles of the switching element, with information being able to be drawn on by a user from a difference between the first and second numerical values or from a quotient from the second numerical value to the first numerical value during operation of the switching element.

The advantage arises from this that the user can be provided in a simple and clear manner with a statement on the wear, in particular the contact wear, and on the remaining switching cycles of the switching element under the given load on the switching element so that the user can replace the switching element at the ideal time on the basis of the information. The switching cycles of the switching element calculated and expected in dependence on the set load stage in the sense of the information in particular reflect a possible maximum total number of switching cycles of the switching element under the set load stage, with the effected switching cycles reflected by the second number not being included therein.

In accordance with a preferred embodiment, the operating unit is formed from a key, a key pad or a rotary switch.

In accordance with a further preferred embodiment, the load stage can be calculated from a load current, a load voltage, a load type and/or an expected switching frequency in a provided application of the switching element.

In accordance with a further preferred embodiment, the load stage to be set can be determined from numerical parameter values which can be drawn on by the user from a diagram and/or from an application-specific query in a data sheet. The diagram advantageously comprises a current/voltage diagram with marked degrees of wear to which the switching element is exposed. The advantage thereby results that the user can see the load stage of the switching element to be set in a very simple manner in accordance with the degree of wear of the switching element in the application and can set it in the control apparatus.

In accordance with a further preferred embodiment, the application-specific query queries an inductive load or an occurrence rate of a specific switching frequency by which the load stage for the switching element can be determined.

In accordance with a further preferred embodiment, the load stage is numerically divided into a range, preferably from zero to six, with the load stage having a number which is as small as possible, in particular zero, corresponding to a highest possible number of switching cycles and with the load stage having a number which is as large as possible, in particular six, corresponding to a lowest number of switching cycles.

In accordance with a further preferred embodiment, the information on the difference between the first and second numerical values reflects a still remaining residual service life of the switching element.

In accordance with a further preferred embodiment, the information on the quotient from the second numerical value to the first numerical value reflects a percentage ratio between the already effected switching cycles and the expected switching cycles of the switching element.

In accordance with a further preferred embodiment, a diagnosis mode can be selected by means of the operating unit in which the still remaining residual service life of the switching element can be displayed without any interruption of the operation of the switching element.

In accordance with a further preferred embodiment, a display unit is provided which displays the set load stage and the effected switching cycles. In this respect, the display unit advantageously displays information on the difference between the first numerical value and the second numerical value, in particular on the still remaining residual service life of the switching element. The display unit advantageously displays the information on the quotient from the second numerical value to the first numerical value, in particular the percentage ratio between the already effected switching cycles and the expected maximum possible switching cycles.

The control apparatus in accordance with the invention can be designed in a similar manner by further features and shows similar advantages in this respect. Such further features are described by way of example, but not exclusively, in the dependent claims following the independent claims.

Figure 2A:
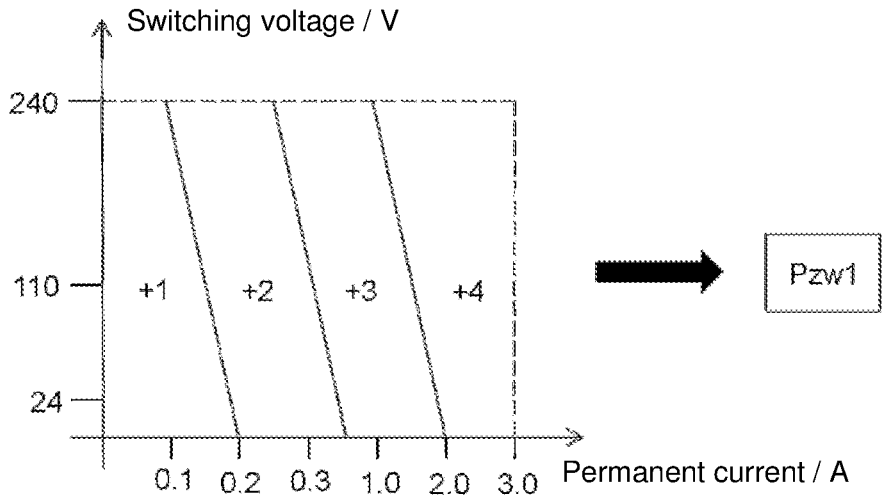
Figure 2B:
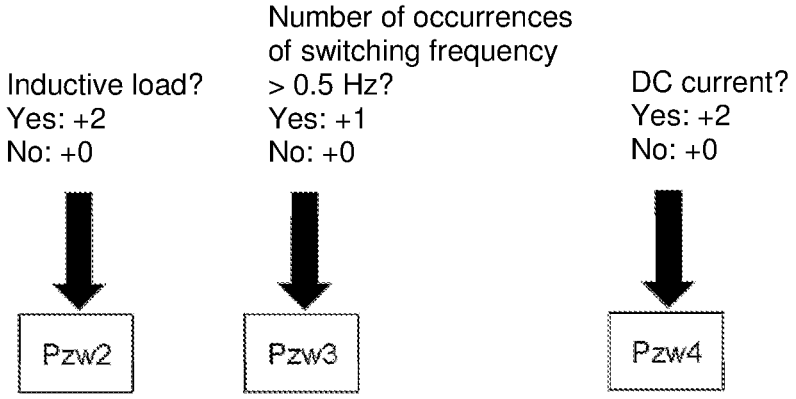
Figure 2C:
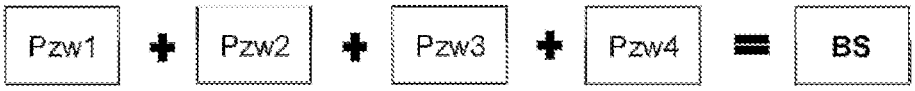
Figure 3A:
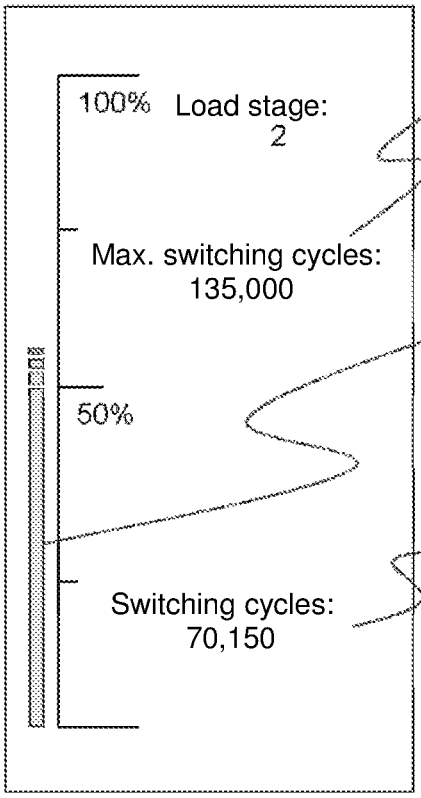
Figure 3B:
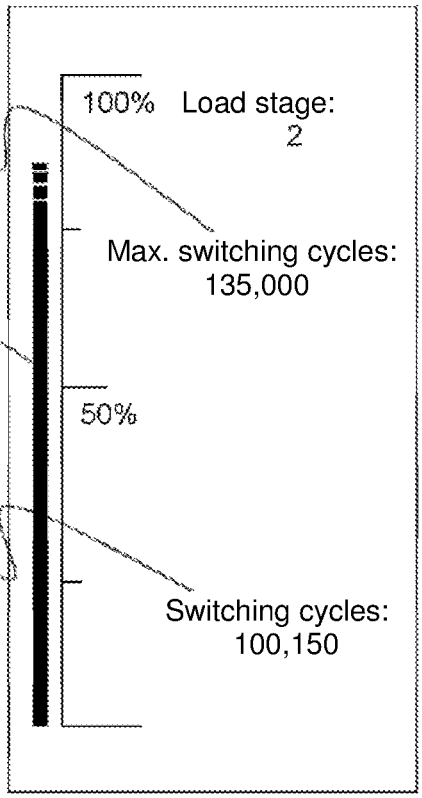

The invention will also be explained in the following with respect to further advantages and features with reference to the enclosed drawing and to embodiments. The Figures of the drawings show in:

FIG. 1 a schematic representation of a control apparatus in accordance with the invention;

FIGS. 2*a*-2*c* a schematic, exemplary representation of a determination in accordance with the invention of a load stage of the switching element; and FIGS. 3*a*-3*b* a schematic, exemplary representation of a display at the control apparatus in accordance with the invention.

A schematic setup of a control apparatus 1 in accordance with the invention for controlling a switching element, in the form of a mechanical relay module, is shown in FIG. 1 to which an actuator A is connected by way of example, wherein the relay module 1 is supplied with input signals via an input line IN to switch the actuator A on or off via n output line OUT or to activate or deactivate a load circuit.

The preferred relay module 1 shown has an operating unit 2 which is provided for setting a load stage BS for the relay module 1. In this respect, the load stage BS represents a load with which the relay module 1 is operated or loaded in its operation. I.e. the load of the relay module 1 depends inter alia on which kind of actuators A is connected to the relay module 1, on how high a load current or a load voltage is switched onto the relay module 1 or on how frequently the relay module 1 has to be switched.

The operating unit 2 is formed in a preferred manner from a key, a key pad or a rotary switch so that a user can set the load stage BS at the relay module 1 in a very simple manner. In the embodiment shown, the operating unit 2 preferably comprises a rotary switch 2 at which the load stages BS are displayed such that the user can carry out the setting at the control apparatus 1 simply by rotating the indicator to the respective load stage BS after the determination of the correct load stage BS of the shown application for the control apparatus 1 in accordance with the invention.

The set load stage BS for the relay module 1 is advantageously likewise stored in the non-volatile memory.

The control unit CPU calculates a first numerical value Z1 for expected switching cycles of the switching element at the set load stage BS on the basis of the set load stage BS, wherein the first numerical value Z1 corresponds to an expected service life, in particular to a maximum service life, of the switching element in dependence on the set load stage BS.

In operation, a control unit CPU determines a second numerical value Z2 which reflects effected switching cycles of the switching element. In this respect, the effected switching cycles can be counted by the control unit CPU and can be stored in a non-volatile memory which belongs to the control unit CPU of the control apparatus in accordance with the invention or of the relay module 1.

The control unit CPU forms a difference from the first and second numerical values Z1 and Z2 or a quotient Z2/Z1 from the second numerical value to the first numerical value Z2 and Z1. Information from the difference between the first and second numerical values Z1 and Z2 or from the quotients Z2/Z1 from the second numerical value to the first numerical value Z2 and Z1 can be drawn on by the user during an operation of the switching element.

The information on the difference between the first and second numerical values Z1 and Z2 reflects a still remaining residual service life of the switching element which results from a comparison between the expected switching cycles or the expected service life of the switching element and the already effected switching cycles or the wear of the switching element. The information on the quotient Z2/Z1 from the second to the first numerical values Z2 and Z1 in turn reflects a percentage ratio between the already effected switching cycles or the wear of the switching element to the expected switching cycles of the switching element or of the maximum possible service life of the switching element.

A schematic, exemplary representation of a determination in accordance with the invention of the load stage BS of the switching element which can be set in the control apparatus 1 is shown in FIGS. 2*a* to 2*c*. The load stage BS can be calculated from a load current, a load voltage, a load type and/or an expected switching frequency in a provided application of the switching element. The load stage BS to be set can be determined from numerical parameter values Pzw1 to Pzw4 which can be drawn on by the user from a diagram and/or from an application-specific query in a data sheet.

After the determination of the load stage BS to be set, the control apparatus 1 can be set as described above and the switching element can be operated in accordance with the provided use.

The shown diagram in FIG. 2*a* comprises a current/voltage diagram with marked degrees of wear of the switching element. The X axis of the diagram represents a permanent current in amperes with which the relay module 1 is loaded. The Y axis of the diagram represents the switching voltage in volts with which the relay module 1 is switched. The area in the dashed rectangle of the switching voltage axis and of the permanent current axis is thus the degree of wear the switching element is exposed to. This degree of wear is divided by way of example into +1 to +4. I.e. the greater the switching voltage and the permanent current are, the greater the degree of wear is which acts on the switching element or the higher the load stage BS is which is to be set for the control apparatus in accordance with the invention or for the relay module in accordance with the invention.

In the embodiment shown, wear of the switching element is the smallest at +1 and the wear of the switching element is correspondingly the largest at +4.

The user can see the first numerical parameter value Pzw1 from the current/voltage diagram.

The user can determine further numerical parameter values Pzw2 to Pzw4 to be taken into account for the determination of the load stage BS for the use of the control apparatus 1 in accordance with the invention from the exemplary, application-specific queries shown in FIG. 2*b*.

The queries can be stored in a data sheet of the control apparatus 1 in accordance with the invention so that the user can read off the matching numerical parameter value Pzw2 to Pzw4 or it can be displayed at the control apparatus 1 in accordance with the invention so that the user can input the matching numerical parameter value Pzw2 to Pw4 by means of the operating unit 2. In the embodiment with a selection of the numerical parameter values Pzw2 to Pzw4 directly at the control apparatus 1 in accordance with the invention, the control apparatus 1 in accordance with the invention has a display unit 3 which displays the application-specific queries to the user so that the user can input the correct numerical parameter value Pzw2 to Pzw4 with respect to the respective application-specific query by means of the operating unit 2 to obtain the correct load stage BS.

The display unit 3 advantageously shows the set load stage BS, the maximum possible switching cycles dependent on the set load stage BS and the effected switching cycles.

The display unit 3 in particular also serves to display the information on the difference between the first and second numerical values Z1 and Z2, i.e. the still remaining residual service life of the switching element, or the information on the quotient Z2/Z1 from the second to the first numerical value Z2 and Z1, i.e. the percentage ratio between the wear and the maximum possible service life of the switching element. In other words, the user can see the still remaining residual service life of the switching element during the operation of the control apparatus 1 in accordance with the invention or of the relay module without interrupting the operation of the switching element in that the user preferably selects a diagnosis mode and allows the information from the difference between the first and second numerical values Z1 and Z2 or, as shown in FIGS. 3*a* and 3*b* as bars, the information from the quotients Z2/Z1 from the second numerical value to the first numerical value Z2 and Z1 to be displayed at the display unit 3.

With reference to the embodiment of the application-specific query shown in FIG. 2*b*, the user can respond with respect to the load type, namely "Inductive load?" or "Direct current?". On a Yes response to the query with respect to the inductive load, a numerical parameter value Pzw2 equal to two (Yes: +2) is set and on a Yes response to the query with respect to the direct current, a numerical parameter value Pzw4 equal to one (Yes: 1) is set. On a respective No response, the numerical parameter values Pzw2 and Pzw4 are set equal to zero (No: +0).

A further application-specific query asks for the number of occurrences of an incidence of a switching frequency at which the control apparatus 1 in accordance with the invention is operated or the switching element is switched. It is determined in this respect whether a switching frequency greater than 0.5 Hz occurs more frequently. On a Yes response to the query with regard to the number of occurrences of the switching frequency greater than 0.5 Hz, a numerical parameter value Pzw3 equal to one (Yes: +1) is set and on a No response, the numerical parameter value Pzw3 equal to zero (No: +0) is set.

In other words, the application-specific query queries an inductive load or the number of occurrences of a specific switching frequency by which the load stage BS for the switching element can be determined.

In accordance with FIG. 2*c*, the numerical parameter values Pzw1 to Pzw4 determined by the user are summed, from which the load stage BS to be set for the control apparatus 1 in accordance with the invention is determined in the corresponding application.

The application-related load stage BS determined in this manner can be set such that the control unit CPU calculates the information relating to the still remaining residual service life of the switching element and can provide it to the user.

A respective schematic, exemplary representation of the display unit 3 is shown at the control apparatus 1 in accordance with the invention in FIGS. 3*a* and 3*b*. The already effected switching cycles ("70,150 or "100,150") and the set load stage BS ("2") are displayed for the user on the display unit 3.

The load stage BS is preferably numerically divided into a range from 0 to 6. In this respect, the load stage BS equal to zero ("0") corresponds to a number of switching cycles which is as high as possible. The load stage BS equal to six ("6") corresponds to a lowest number of switching cycles. In other words, at the load stage BS equal to zero, the relay module in accordance with the invention is loaded the least in operation, whereas at the load stage BS equal to six, the relay module in accordance with the invention is loaded the most in operation.

In addition to the shown load stage BS and the already effected switching cycles (70,150 or 100,150), the user can see the still remaining residual service life of the switching element using the displayed information from the difference between the effected switching cycles (10,150 or 100,150) of the switching element and the expected switching cycles (135,000) of the switching element dependent on the load stage BS or using the displayed bar of the information on the quotient Z2/Z1 from the effected switching cycles (70,150 or 100,150) to the maximum possible switching cycles (135,000) of the switching element.

The information of the display in FIG. 3*a* indicates to the user that the relay module is still in a good condition since a consumed service life of the switching element is a little above half the expected (maximum) service life of the switching element at the load stage equal to two. It is advantageous in this respect that the shown bar displays the information from the quotient Z2/Z1 from the second to the first numerical values Z2 and Z1 in percent. The user can hereby read off the percentage wear of the switching element with respect to the maximum possible service life of the switching element. The user can, in contrast, see from the information of the display in FIG. 3*b* that a wear of the switching element is already significantly high so that a replacement of the switching element should be carried out soon.

The user thus obtains an overview on the wear of the switching element in accordance with the invention at any time directly at a machine having the control apparatus 1 in accordance with the invention and can carry out a servicing of the relay module in a time and cost optimized manner. I.e. with respect to FIG. 3*a*, for example, that the user acquires the information that, if the switching element has been operated for one year at the load stage BS equal to two ("2"), the switching element can be operated for still almost a further one year at 70,150 switching processes effected up to then since the wear is just a above half the expected maximum possible service life of the switching element. The servicing or the replacement of the switching element can therefore be planned in a time and cost optimized manner.

In a preferred embodiment of the control apparatus 1 in accordance with the invention, the user can change the load stage BS by means of the operating unit 2, for example in accordance with a change of the application, so that the control unit CPU can determine the first numerical value Z1 again which corresponds to the newly set load stage BS. When calculating the new first numerical value Z1, the previous information with respect to the previous wear of the relay module is also taken into the calculation. The newly obtained information from the difference between the first and second numerical values Z1 and Z2 or the information from the quotient Z2/Z1 from the second to the first numerical values Z2 and Z1, on the one hand, indicates to the user how high the already consumed service life or the percentage wear of the switching element is while taking account of the newly set load stage BS and, on the other hand, whether a further operation of the relay module is economic under the new load stage BS or whether a replacement should be carried out immediately or in the near future.

The result may therefore advantageously arise in the new calculation that the display unit 3 indicates 100% as the information. This means that with the set new load stage BS a failure of the relay module would result in the direct future so that it would be advisable not to operate the already used and thus worn switching element under the newly set load stage BS or in accordance with the new application.

The user is given the possibility to avoid a failure of the switching element in operation under the new application in advance in that he replaces the used switching element with a new switching element which is more suitable for the newly set load stage BS of the new application.

The display of the information at the display unit 3 can furthermore in particular change faster if the newly set load stage BS is a higher load stage BS.

In the converse case in which the switching element is set by a high-wear application having a large load stage BS to a low-wear application having a small load stage BS, the control apparatus 1 in accordance with the invention displays a large interval between the already consumed service life of the switching element and the newly expected (maximum) service life of the switching element so that a corresponding servicing time can be displaced backward in time.

The user hereby obtains a higher planning certainty for the service of the switching element.

REFERENCE NUMERAL LIST

1 control apparatus
2 operating unit
3 display unit
A actuator
BS load stage
CPU control unit
IN input line
OUT output line
Pzw1 to Pzw4 numerical parameter value
Z1 first numerical value
Z2 second numerical value

The invention claimed is:

1. A control apparatus for controlling a switching element comprising an operating unit for setting a load stage at which the switching element is operable; and a control unit configured to calculate a first numerical value, with the first numerical value reflecting expected switching cycles of the switching element estimated on the basis of the set load stage and with the first numerical value corresponding to an expected service life of the switching element in dependence on the set load stage, wherein the control unit is further configured to determine a second numerical value, with the second numerical value reflecting effected switching cycles of the switching elements, wherein information from a difference between the first and second numerical values or from a quotient from the second numerical value to the first numerical value can be drawn on by a user during an operation of the switching element.

2. The control apparatus in accordance with claim 1, wherein the switching element is a mechanical relay.

3. The control apparatus in accordance with claim 1, wherein the operating unit is formed from one of a key, a key pad and a rotary switch.

4. The control apparatus in accordance with claim 1, wherein the load stage can be calculated from at least one of a load current, a load voltage, a load type and an expected switching frequency in a provided application of the switching element.

5. The control apparatus in accordance with claim 1, wherein the load stage to be set can be determined from numerical parameter values, with the numerical parameter values being able to be drawn on by the user from at least one of a diagram and an application-specific query in a data sheet.

6. The control apparatus in accordance with claim 5, wherein the diagram comprises a current/voltage diagram having marked degrees of wear to which the switching element is exposed.

7. The control apparatus in accordance with claim 5, wherein the application-specific query asks for an inductive load or a number of occurrences of a specific switching frequency by which the load stage for the switching element can be determined.

8. The control apparatus in accordance with claim 1, wherein the load stage is numerically divided into a range, wherein the load stage having a number which is as small as possible corresponds to a number of switching cycles which is as high as possible, and wherein the load stage having a number which is as large as possible corresponds to a lowest number of switching cycles.

9. The control apparatus in accordance with claim 8, wherein the load stage is numerically divided into a range from zero to six.

10. The control apparatus in accordance with claim 8, wherein the number of the load stage which is as small as possible is zero.

11. The control apparatus in accordance with claim 8, wherein the number of the load stage which is as large as possible is six.

12. The control apparatus in accordance with claim 1, wherein the information on the difference reflects a still remaining residual service life of the switching element.

13. The control apparatus in accordance with claim 12, wherein a diagnosis mode can be selected by means of the operating unit in which the still remaining residual service life of the switching element or the percentage ratio can be displayed without any interruption of the operation of the switching element.

14. The control apparatus in accordance with claim 1, wherein the information on the quotient reflects a percentage ratio between the already effected switching cycles and the expected switching cycles of the switching element.

15. The control apparatus in accordance with claim 14, wherein a diagnosis mode can be selected by means of the operating unit in which the still remaining residual service life of the switching element or the percentage ratio can be displayed without any interruption of the operation of the switching element.

16. The control apparatus in accordance with claim 1, further comprising a display unit that is configured to display the set load stage and the effected switching cycles.

17. The control apparatus in accordance with claim 16, wherein the display unit is configured to display the information on the difference between the first and second numerical values or the information on the quotient from the second numerical value to the first numerical value.

* * * * *